US010049621B2

(12) United States Patent
Hwang et al.

(10) Patent No.: US 10,049,621 B2
(45) Date of Patent: Aug. 14, 2018

(54) ORGANIC LIGHT EMITTING DISPLAY DEVICE WITH INCREASED LUMINANCE UNIFORMITY

(71) Applicant: SAMSUNG DISPLAY CO., LTD., Yongin-si, Gyeonggi-do (KR)

(72) Inventors: Young-In Hwang, Suwon-si (KR); Chul-Kyu Kang, Suwon-si (KR); Ji-Hye Kong, Seongnam-si (KR); Yong-Sung Park, Seoul (KR); Jae-Hoon Lee, Seoul (KR); Tak-Young Lee, Anyang-si (KR); Young-Jin Cho, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 53 days.

(21) Appl. No.: 15/380,140

(22) Filed: Dec. 15, 2016

(65) Prior Publication Data

US 2017/0193919 A1 Jul. 6, 2017

(30) Foreign Application Priority Data

Jan. 4, 2016 (KR) ..... 10-2016-0000289

(51) Int. Cl.

| | |
|---|---|
| ***G09G 3/3291*** | (2016.01) |
| ***G09G 3/3266*** | (2016.01) |
| ***G09G 3/325*** | (2016.01) |

(52) U.S. Cl.

CPC ..... *G09G 3/3291* (2013.01); *G09G 3/325* (2013.01); *G09G 3/3266* (2013.01); *G09G 2300/043* (2013.01); *G09G 2300/0809* (2013.01); *G09G 2310/08* (2013.01); *G09G 2320/0233* (2013.01)

(58) Field of Classification Search

CPC .... G09G 3/3291; G09G 3/3266; G09G 3/325; G09G 2300/0809; G09G 2300/043; G09G 2310/08; G09G 2320/0233

See application file for complete search history.

(56) References Cited

U.S. PATENT DOCUMENTS

2016/0133191 A1* 5/2016 Kang ..... G09G 3/3258 345/212

FOREIGN PATENT DOCUMENTS

KR 1020120000887 1/2012

* cited by examiner

*Primary Examiner* — Larry Lee

(74) *Attorney, Agent, or Firm* — F. Chau & Associates, LLC

(57) ABSTRACT

An organic light emitting display device includes a pixel unit and a driving unit. The pixel unit includes at least one pixel and the driving unit is configured to drive the pixel unit. The at least one pixel includes a first switching transistor, a second switching transistor, a third switching transistor, a fourth switching transistor, a first capacitor, a second capacitor, an organic light emitting diode, a third capacitor, and a driving transistor.

21 Claims, 17 Drawing Sheets

ORGANIC LIGHT EMITTING DISPLAY DEVICE WITH INCREASED LUMINANCE UNIFORMITY

CROSS-REFERENCE TO RELATED APPLICATION

This application claims priority under 35 U.S.C. § 119 to Korean Patent Application No. 10-2016-0000289, filed on Jan. 4, 2016 in the Korean Intellectual Property Office (KIPO), the disclosure of which is incorporated by reference herein in its entirety.

TECHNICAL FIELD

Exemplary embodiments of the inventive concept relate to a transparent display device and an electronic device having the same, and more particularly, to a pixel and a display device having the same.

DISCUSSION OF RELATED ART

Flat panel display (FPD) devices are widely used as displays for electronic devices because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices. OLED devices have been spotlighted as next-generation display devices because they have wide viewing angles, rapid response speed, relatively low thickness, low power consumption, etc.

An OLED device may be operated using a sequential emission driving technique or a simultaneous emission driving technique. The sequential emission driving technique sequentially performs a scanning operation on a scan line basis, and then sequentially controls pixel circuits to emit light for each scan line (e.g., sequentially performs a light emitting operation). On the other hand, the simultaneous emission driving technique sequentially performs the scanning operation on a scan line basis, and then controls all pixel circuits to simultaneously emit light (e.g., simultaneously performs the light emitting operation).

The light emitting operation is simultaneously performed for all pixel circuits to display one image frame. Thus, an emission waiting time (e.g., a waiting time for the light emitting operation) of the pixel circuits coupled to the upper scan lines may be longer than an emission waiting time of the pixel circuits coupled to the lower scan lines if the scanning operation is sequentially performed from the top scan line to the bottom scan line, or vice-versa. Thus, a difference between these emission waiting times may result in a voltage drop due to a leakage current, etc. (e.g., a change of data voltages stored in storage capacitors of the pixel circuits). As a result, the luminance uniformity of a display panel included in the OLED device may be greatly degraded.

SUMMARY

According to an exemplary embodiment of the inventive concept, an organic light emitting display device includes a pixel unit and a driving unit. The pixel unit includes at least one pixel and the driving unit is configured to drive the pixel unit. The at least one pixel includes a first switching transistor, a second switching transistor, a third switching transistor, a fourth switching transistor, a first capacitor, a second capacitor, an organic light emitting diode, a third capacitor, and a driving transistor. The first switching transistor is configured to turn on in response to a first scan signal provided through an Nth scan line. The first switching transistor is coupled between a data line and a first node and N is an integer greater than or equal to 1. The second switching transistor is configured to turn on in response to a first control signal and is coupled between a reference voltage providing line and a second node. The third switching transistor is configured to turn on in response to a second control signal and is coupled between the first node and the second node. The fourth switching transistor is configured to turn on in response to a second scan signal provided through an (N+2)th scan line and is coupled between an initialization line and a third node. The first capacitor is coupled between the first node and the third node. The second capacitor is coupled between the second node and the third node. The organic light emitting diode has an anode electrode coupled to the third node and a cathode node coupled to a low-power voltage line. The third capacitor is coupled between the third node and the cathode electrode of the organic light emitting diode. The driving transistor has a gate electrode coupled to the second node, a first electrode coupled to a high-power voltage line, and a second electrode coupled to the third node. The driving transistor is configured to control a driving current flowing through the organic light emitting diode in response to a voltage of the second node.

The driving unit receives an input data for the pixel and divides one frame into a non-emission period, a first initialization period, a threshold voltage compensation period, a data writing period, a second initialization period, and an emission period.

The organic light emitting diode does not emit light in the non-emission period.

The anode electrode of the organic light emitting diode is initialized to an initialization voltage in the first initialization period.

A threshold voltage of the driving transistor is stored in the second capacitor in the threshold voltage compensation period.

A data voltage, corresponding to the input data, is provided to the pixel in response to the first scan signal in the data writing period.

The anode electrode of the organic light emitting diode is initialized to an initialization voltage in the second initialization period.

Emission waiting times of the at least one pixel are substantially the same and in the emission period, each of the at least one pixel emits light at substantially the same time.

The first switching transistor turns on in response to the first scan signal provided through the Nth scan line in the non-emission period and the data writing period, and provides a data voltage to the first node.

The second switching transistor turns on in response to the first control signal in the non-emission period, the threshold voltage compensation period, and the data writing period, and provides a reference voltage to the second node.

The third switching transistor turns on in response to the second control signal in the threshold voltage compensation period and the emission period, and couples the second node and the third node.

The fourth switching transistor turns on in response to the second scan signal provided through the (N+2)th scan line in the first initialization period and the second initialization period, and provides an initialization voltage to the third node.

According to an exemplary embodiment of the inventive concept, an organic light emitting display device includes a pixel unit and a driving unit. The pixel unit includes at least one pixel and the driving unit is configured to drive the pixel unit. The at least one pixel includes a first switching transistor, a second switching transistor, a first capacitor, a second capacitor, an organic light emitting diode, a third capacitor, and a driving transistor. The first switching transistor is configured to turn on in response to a scan signal provided through a scan line and is coupled between a data line and a first node. The second switching transistor is configured to turn on in response to a control signal and is coupled between the first node and a second node. The first capacitor is coupled between the first node and a third node. The second capacitor is coupled between the second node and the third node. The organic light emitting diode has an anode electrode coupled to the third node and a cathode electrode coupled to a low-power voltage line. The third capacitor is coupled between the third node and the cathode electrode of the organic light emitting diode. The driving transistor has a gate electrode coupled to the second node, a first electrode coupled to a high-power voltage line, and a second electrode coupled to the third node. The driving transistor is configured to control a driving current flowing through the organic light emitting diode in response to a voltage of the second node.

The driving unit receives an input data for the pixel and divides one frame into a non-emission period, an initialization period, a threshold voltage compensation period, a data writing period, and an emission period.

The organic light emitting diode does not emit in the non-emission period.

The anode electrode of the organic light emitting diode is initialized to an initialization voltage in the initialization period.

A difference between a threshold voltage of the driving transistor and a reference voltage is stored in the second capacitor in threshold voltage compensation period.

A data voltage, corresponding to the input data, is provided to the pixel in response to the scan signal in the data writing period.

Emission waiting times of the at least one pixel are substantially the same and in the emission period, each of the at least one pixel emits light at substantially the same time.

The driving unit provides a high-power voltage having a first voltage level in the non-emission period and the initialization period and a second voltage level in the data writing period and the emission period.

According to an exemplary embodiment of the inventive concept, an organic light emitting display device includes a pixel unit, a data driver, a scan driver, a power voltage generator, and a timing controller. The pixel unit includes at least one pixel. The data driver is configured to provide a data voltage to the pixel unit. The scan driver is configured to provide a first and second scan signal to the pixel unit. The power voltage generator is configured to provide a reference voltage, an initialization voltage, a high-power voltage, and a low-power voltage to the pixel unit. The timing controller is configured to provide timing control signals to the data driver and the scan driver. The at least one pixel includes a first switching transistor, a second switching transistor, a third switching transistor, a fourth switching transistor, a driving transistor, and an organic light emitting diode. The first switching transistor has a gate electrode coupled to a first scan line providing the first scan signal, a first electrode coupled to a data line providing the data voltage, and a second electrode coupled to a first node. The second switching transistor has a gate electrode coupled to a first control line providing a first control signal, a first electrode coupled to a reference voltage providing line providing the reference voltage, and a second electrode coupled to a second node. The third switching transistor has a gate electrode coupled to a second control line providing a second control signal, a first electrode coupled to the first node, and a second electrode coupled to the second node. The fourth switching transistor has a gate electrode coupled to a second scan line providing the second scan signal, a first electrode coupled to an initialization line providing the initialization voltage, and a second electrode coupled to a third node. The driving transistor has a gate electrode coupled to the second node, a first electrode coupled to a high-power voltage line providing the high-power voltage, and a second electrode coupled to the third node. The organic light emitting diode has an anode electrode coupled to the third node and a cathode electrode coupled to a low-power voltage line providing the low-power voltage.

BRIEF DESCRIPTION OF THE DRAWINGS

The above and other features will be more clearly understood by describing in detail exemplary embodiments thereof with reference to the accompanying drawings.

DETAILED DESCRIPTION OF THE EMBODIMENTS

Figure 1:
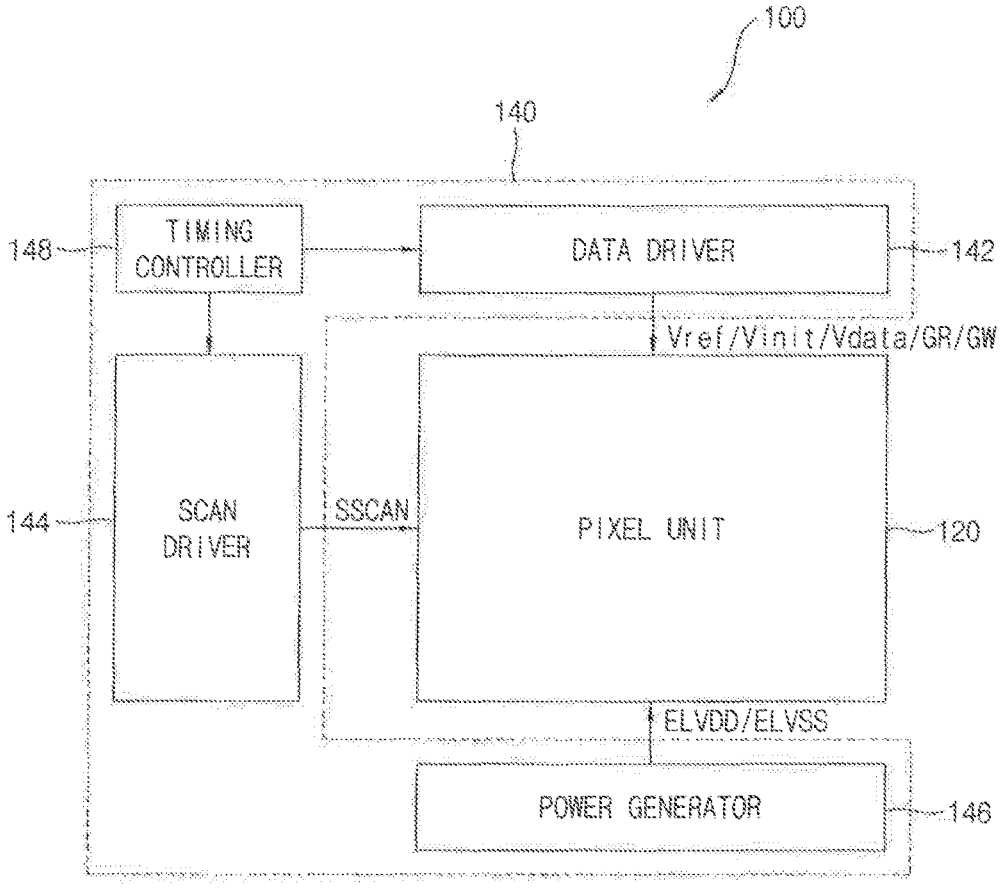
FIG. 1 is a block diagram illustrating an organic light emitting display device according to an exemplary embodiment of the inventive concept.

Exemplary embodiments of the inventive concept will be described more fully hereinafter with reference to the accompanying drawings. Like reference numerals refer to like elements throughout the accompanying drawings.

Exemplary embodiments of the inventive concept provide an organic light emitting display (OLED) device with increased luminance uniformity.

Figure 2:
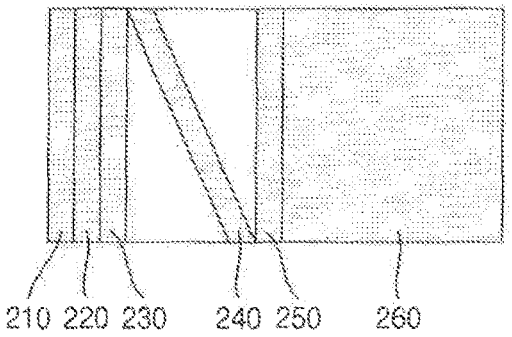
FIG. 2 is a diagram to illustrate a driving method of the organic light emitting display device of FIG. 1 according to an exemplary embodiment of the inventive concept.

FIG. 1 is a block diagram illustrating an organic light emitting display device and FIG. 2 is a diagram to illustrate a driving method of the organic light emitting display device of FIG. 1, according to an exemplary embodiment of the inventive concept.

Referring to FIG. 1, an organic light emitting display device 100 may include a pixel unit 120 and a driving unit 140.

The pixel unit 120 may be coupled to a data driver 142 of the driving unit 140 through a plurality of data lines. The pixel unit 120 may be coupled to a scan driver 144 of the driving unit 140 through a plurality of scan lines. The pixel unit 120 may be coupled to a power voltage generator 146 of the driving unit 140 through power voltage lines. The pixel unit 120 may include at least one pixel formed in intersection regions of the plurality of data lines and the plurality of scan lines. Each of the pixels may be operated in response to signals provided from the driving unit 140. The at least one pixel will be described in detail below with reference to FIG. 3.

The driving unit 140 may drive the pixel unit 120. The driving unit 140 may include the data driver 142, the scan driver 144, a timing controller 148, and the power voltage generator 146. The data driver 142 may convert an input data into a data voltage Vdata corresponding to the input data, provide a reference voltage Vref though a reference voltage providing line, provide a data voltage Vdata through a data line, and provide an initialization voltage Vinit through an initialization line. Further, the data driver 142 may provide a first control signal GR to the pixel unit 120 through a first control line and a second control signal GW to the pixel unit 120 through a second control line. The scan driver 144 may provide a scan signal SSCAN to the pixel unit 120 through the plurality of scan lines. The power voltage generator 146 may provide a high-power voltage ELVDD to the pixel unit 120 through high-power voltage lines and a low-power voltage ELVSS to the pixel unit 120 through low-power voltage lines.

The timing controller 148 may control an operation of the organic light emitting display device 100. For example, the timing controller 148 may control the operation of the organic light emitting display device 100 by providing timing control signals to the data driver 142 and the scan driver 144. According to exemplary embodiments of the inventive concept, the data driver 142, the scan driver 144, and the timing controller 148 may be implemented as an integrated circuit (IC). Alternatively, the data driver 142, the scan driver 144, and the timing controller 148 may be implemented as two or more integrated circuits (IC).

Although the data driver 140 provides the reference voltage Vref and the initialization voltage Vinit to the pixel unit 120 as described with reference to FIG. 1, the organic light emitting display device 100 is not limited thereto. For example, the power voltage generator 146 may provide the reference voltage Vref and the initialization voltage Vinit to the pixel unit 120.

Referring to FIG. 2, the driving unit 140 may receive the input data for the pixel and divide one frame into a non-emission period 210, a first initialization period 220, a threshold voltage compensation period 230, a data writing period 240, a second initialization period 250, and an emission period 260.

In the non-emission period 210, the data driver 142 of the driving unit 140 may provide the reference voltage Vref to the pixel unit 120 through the reference voltage providing line and provide the data voltage Vdata of a previous frame to the pixel unit 120 through the data line. Additionally, the scan driver 144 of the driving unit 140 may provide the scan signal SSCAN to the pixel unit 120 through the scan line. Here, an organic light emitting diode of the pixels in the pixel unit 120 does not emit light in response to the signals provided from the driving unit 140. In the first initialization period 220, the data driver 142 or the power voltage generator 146 may provide the initialization voltage Vinit to the pixel unit 120 through the initialization line. Here, an anode electrode of the organic light emitting diode may be initialized in response to the signals provided from the driving unit 140. In the threshold voltage compensation period 230, the data driver 142 or the power voltage generator 146 may provide the reference voltage Vref to the pixel unit 120 through the reference voltage providing line. Here, a threshold voltage of a driving transistor in the pixel may be stored in response to the signals provided from the driving unit 140.

In the data writing period 240, the scan driver 144 of the driving unit 140 may provide the scan signal SSCAN to the pixel unit 120 through the scan line and the data driver 142 of the driving unit 140 may provide the data voltage Vdata, corresponding to the input data to the pixel unit 120, through the data line. Here, the data voltage Vdata may be stored in the capacitor in the pixel in response to the signals provided from the driving unit 140. In the second initialization period 250, the data driver 142 or the power voltage generator 146 may provide the initialization voltage Vinit to the pixel unit 120 through the initialization line. Here, the anode electrode of the organic light emitting diode may be initialized in response to the signals provided from the driving unit 140. In the emission period 260, all pixels of the pixel unit 120 may simultaneously emit light in response to the data voltage Vdata stored during the data writing period 240.

As described above, the organic light emitting display device 100, according to exemplary embodiments of the inventive concept, may divide one frame into the non-emission period 210, the first initialization period 220, the threshold voltage compensation period 230, the data writing period 240, the second initialization period 250, and the emission period 260. Here, emission waiting times of the pixels may be substantially the same because the organic light emitting display device 100 includes the second initialization period 250. Thus, the luminance uniformity defect that occurs due to differences in emission waiting times of the pixels may be minimized. Further, because the organic light emitting display device includes the threshold voltage compensation period 230, the threshold voltage of the driving transistor may be compensated and a uniform driving current may flow through the organic light emitting diode regardless of the threshold voltage of the driving transistor. Thus, the luminance uniformity defect that occurs due to the difference of the threshold voltages of the pixels may be minimized. If the pixel includes transistors coupled to a source electrode or a drain electrode of the driving transistor (e.g., an emission control transistor), a voltage higher than the high-power voltage ELVDD may need to be provided to the pixels through the high-power voltage line in consideration of a voltage drop. However, the pixel of the organic light emitting display device 100, according to exemplary embodiments of the inventive concept, does not include transistors coupled to a source electrode or a drain electrode of the driving transistor. Thus, power consumption of the organic light emitting display device 100 may be reduced.

Figure 3:
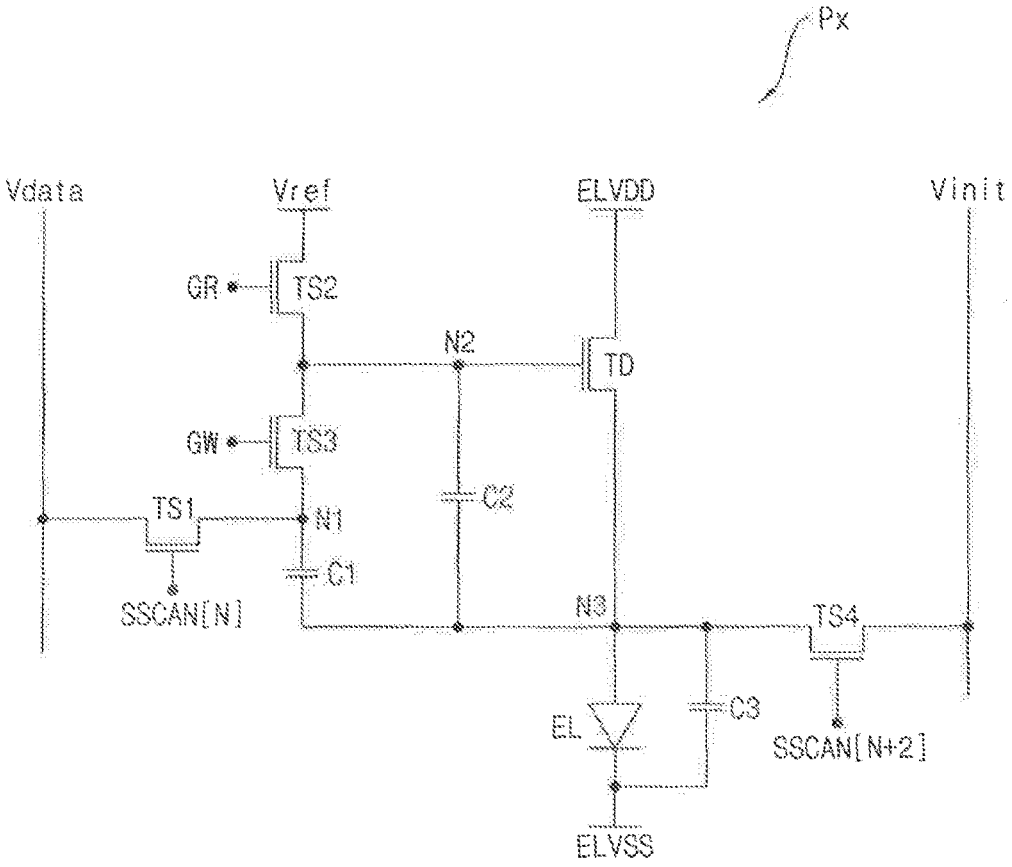
FIG. 3 is a circuit diagram illustrating a pixel included in the organic light emitting display device of FIG. 1 according to an exemplary embodiment of the inventive concept.

FIG. 3 is a circuit diagram illustrating a pixel included in the organic light emitting display device of FIG. 1 according to an exemplary embodiment of the inventive concept.

Referring to FIG. 3, a pixel Px may include a first switching transistor TS1, a second switching transistor TS2, a third switching transistor TS3, a fourth switching transistor TS4, a first capacitor C1, a second capacitor C2, an organic light emitting diode EL, a third capacitor C3, and a driving transistor TD.

A gate electrode of the first switching transistor TS1 may be coupled to an Nth scan line, where N is an integer greater than or equal to 1. The first switching transistor TS1 may turn on in response to a scan signal SSCAN[N] provided through the Nth scan line. The first switching transistor TS1 may be coupled between a data line (providing the data voltage Vdata) and a first node N1. A gate electrode of the second switching transistor TS2 may be coupled to a first control line. The second switching transistor TS2 may turn on in response to a first control signal GR provided through the first control line. The second switching transistor TS2 may be coupled between a reference voltage proving line (providing the reference voltage Vref) and a second node N2. A gate electrode of the third switching transistor TS3 may be coupled to a second control line. The third switching transistor TS3 may turn on in response to a second control signal GW provided through the second control line. The third switching transistor TS may be coupled between the first node N1 and the second node N2.

A gate electrode of the fourth switching transistor TS4 may be coupled to an (N+2)th scan line. The fourth switching transistor TS may turn on in response to a scan signal SSCAN[N+2] provided from the (N+2)th scan line. The fourth switching transistor TS4 may be coupled between an initialization line (providing the initialization voltage Vinit) and a third node N3. The first capacitor C1 may store the data voltage Vdata provided through the first switching transistor TS1. The second capacitor C2 may be coupled between the second node N2 and the third node N3. The second capacitor C2 may store a threshold voltage of the driving transistor TD. The organic light emitting diode EL may have an anode electrode coupled to the third node N3 and a cathode electrode coupled to a low-power voltage line (with the low-power voltage ELVSS). The organic light emitting diode EL may emit light based on a driving current provided from the driving transistor TD. The third capacitor C3 may be coupled between the third node N3 and the cathode electrode of the organic light emitting diode EL. A gate electrode of the driving transistor TD may be coupled to the second node N2. A first electrode of the driving transistor TD may be coupled to a high-power voltage line (with the high-power voltage ELVDD). A second electrode of the driving transistor TD may be coupled to the third node N3. The driving transistor TD may control the driving current flowing through the organic light emitting diode EL.

Although transistors of the pixel Px of the organic light emitting display device 100 (including the first switching transistor TS1, the second switching transistor TS2, the third switching transistor TS3, the fourth switching transistor TS4, and the driving transistor TD) may be implemented as n-channel metal oxide semiconductor (NMOS) transistors, the inventive concept is not limited thereto. For example, the transistors of the pixel Px may be implemented as p-channel metal oxide semiconductor (PMOS) transistors.

Figure 4:
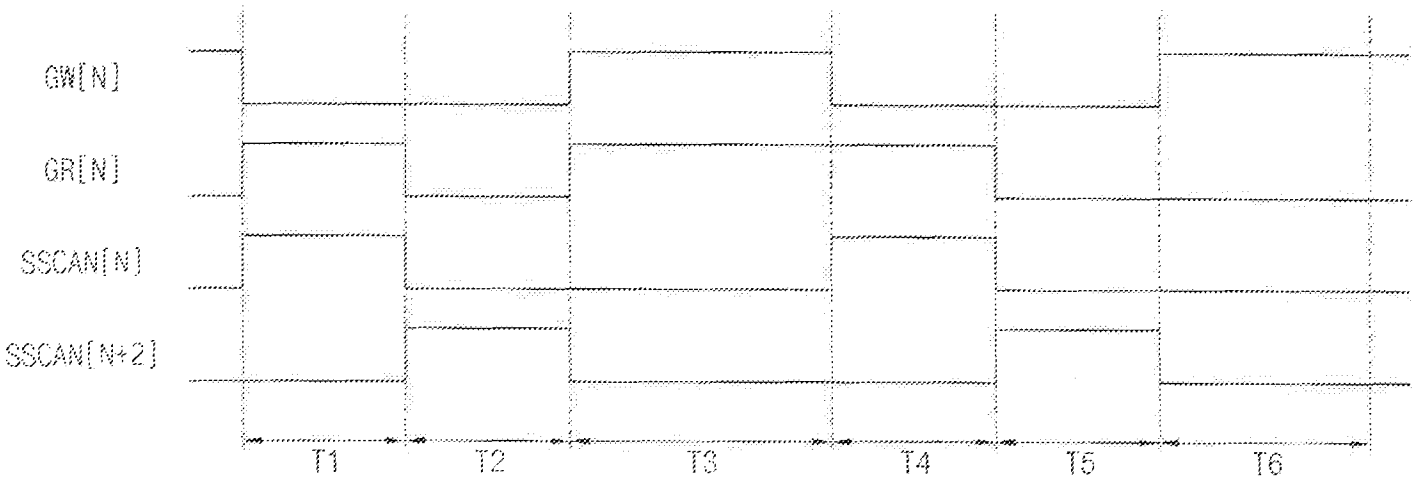
FIG. 4 is a timing diagram to illustrate an operation of the pixel of FIG. 3 according to an exemplary embodiment of the inventive concept.

FIG. 4 is a timing diagram to illustrate an operation of the pixel of FIG. 3, and FIGS. 5A through 5F are circuit diagrams to illustrate an operation of the pixel of FIG. 3, according to an exemplary embodiment of the inventive concept.

Referring to FIG. 4, a driving unit (e.g., the driving unit 140 of FIG. 1) may receive input data for the pixel Px and may divide one frame into a non-emission period T1, a first initialization period T2, a threshold voltage compensation period T3, a data writing period T4, a second initialization period T5, and an emission period T6.

Figure 5A:
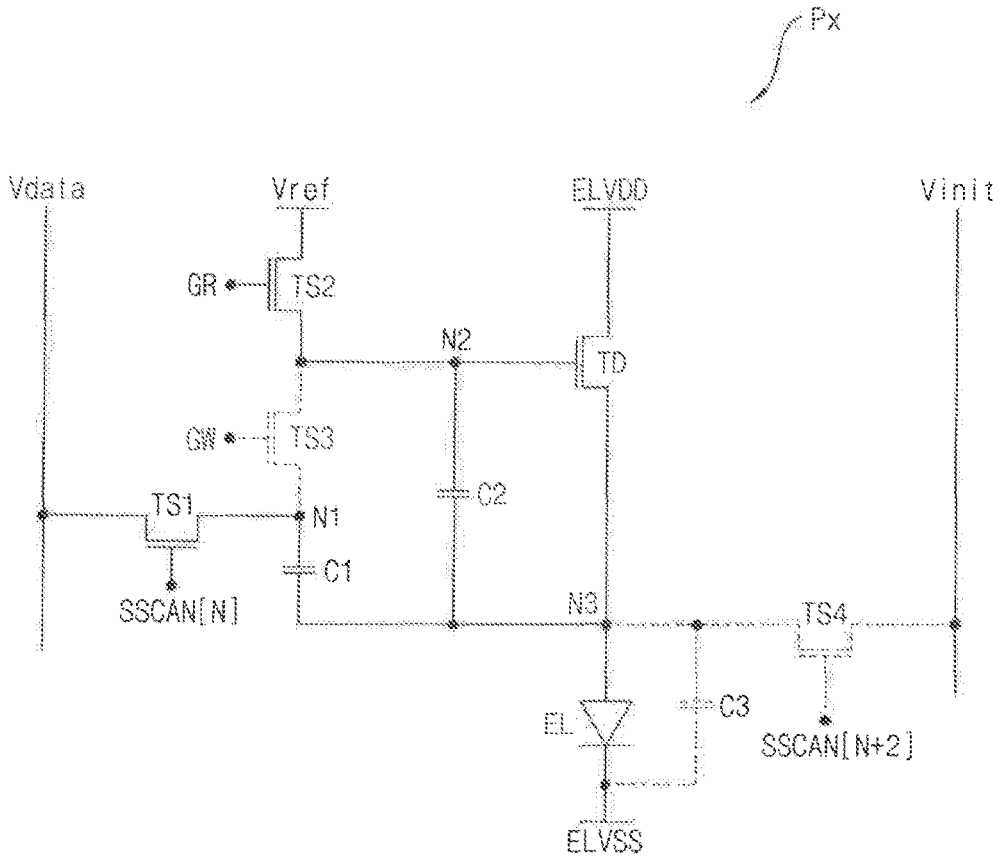
FIGS. 5A through 5F are circuit diagrams to illustrate an operation of the pixel of FIG. 3 according to an exemplary embodiment of the inventive concept.

The reference voltage Vref may be provided to the pixel Px so as to not emit light from the organic light emitting diode EL after the emission period T6 of a previous frame. Referring to FIG. 5A, in the non-emission period T1, the first control signal GR may be provided to the pixel Px through the first control line. The second switching transistor TS2 may turn on in response to the first control signal GR and couple the reference voltage providing line and the second node N2. Thus, the reference voltage Vref may be provided to the second node N2. A voltage of the anode electrode of the organic light emitting diode EL may be provided to the third node N3. The driving transistor TD does not operate as a voltage difference between the second node N2 and the third node N3 (e.g., a voltage difference between the gate electrode and the source electrode of the driving transistor TD) is less than 0. Thus, the organic light emitting diode EL does not emit light. Here, the first switching transistor TS1 may turn on in response to the scan signal SSCAN[N] provided through the Nth scan line and provide the data voltage Vdata of the previous frame, provided through the data line, to the first node N1.

Figure 5B:
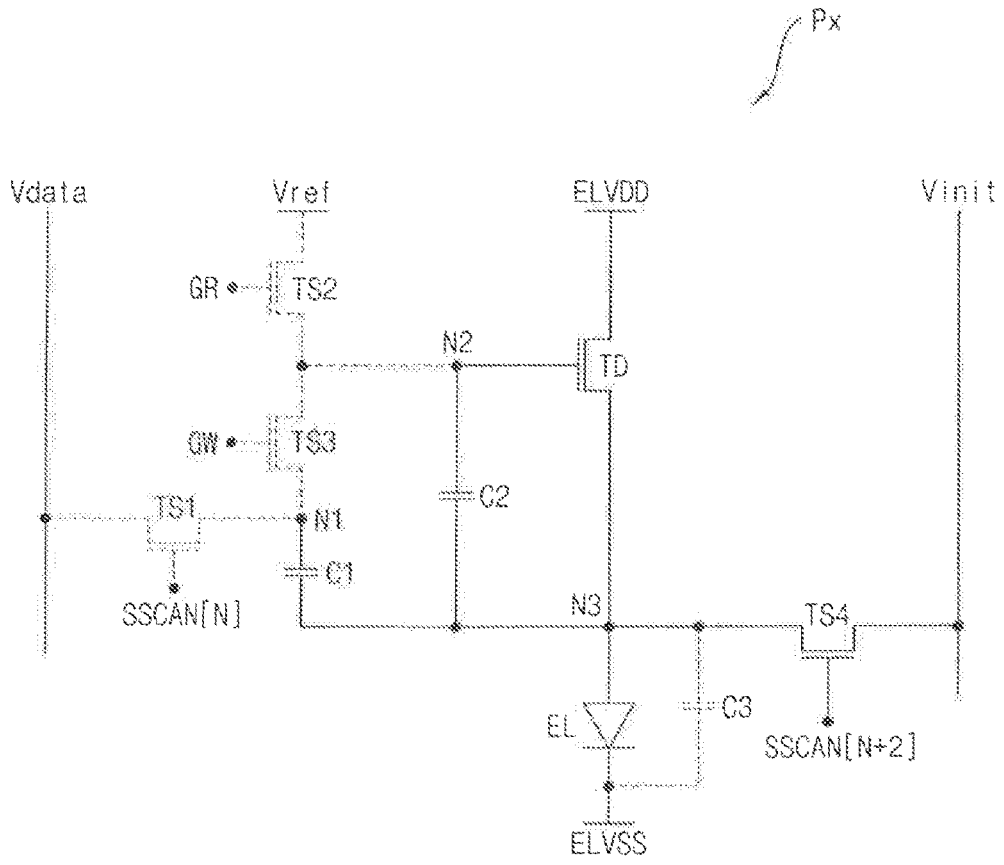

Referring to FIG. 5B, in the first initialization period T2, the scan signal SSCAN[N+2] may be provided to the pixel Px through the (N+2)th scan line and the initialization voltage Vinit may be provided to the pixel Px through the initialization line. The fourth switching transistor TS4 may turn on in response to the scan signal SSCAN[N+2] provided through the (N+2)th scan line and couple the initialization line and the third node N3. Thus, the anode electrode of the organic light emitting diode EL may be initialized to the initialization voltage Vinit.

Figure 5C:
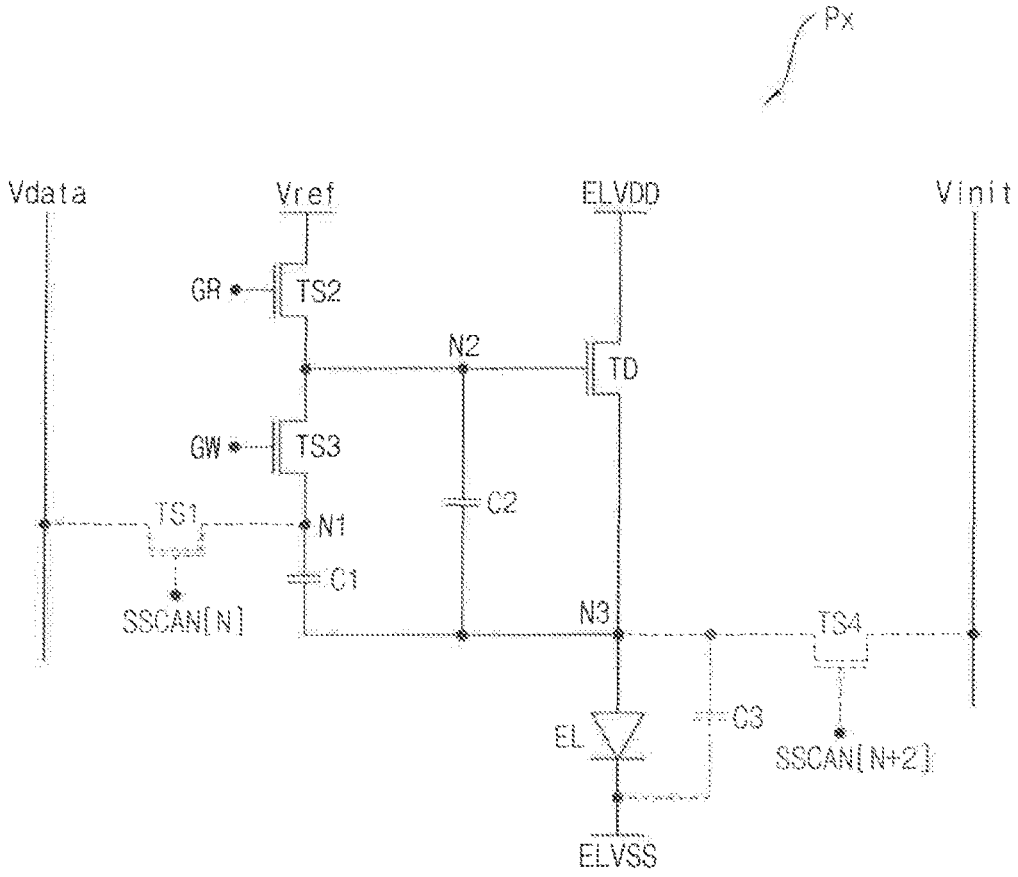

Referring to FIG. 5C, in the threshold voltage compensation period T3, the first control signal GR may be provided to the pixel Px through the first control line and the second control signal GW may be provided to the pixel Px through the second control line. The second switching transistor TS2 may turn on in response to the first control signal GR and couple the reference voltage providing line and the second node N2. Thus, the reference voltage Vref may be provided to the second node N2. The third switching transistor TS3 may turn on in response to the second control signal GW and couple the second node N2 and the first node N1. Thus, the reference voltage Vref may be provided to the first node N1. The driving transistor TD may turn on in response to the reference voltage Vref provided to the second node N2. Thus, the threshold voltage of the driving transistor TD (e.g., the voltage difference between the gate electrode and the source electrode of the driving transistor TD) may be stored in the second capacitor C2.

Figure 5D:
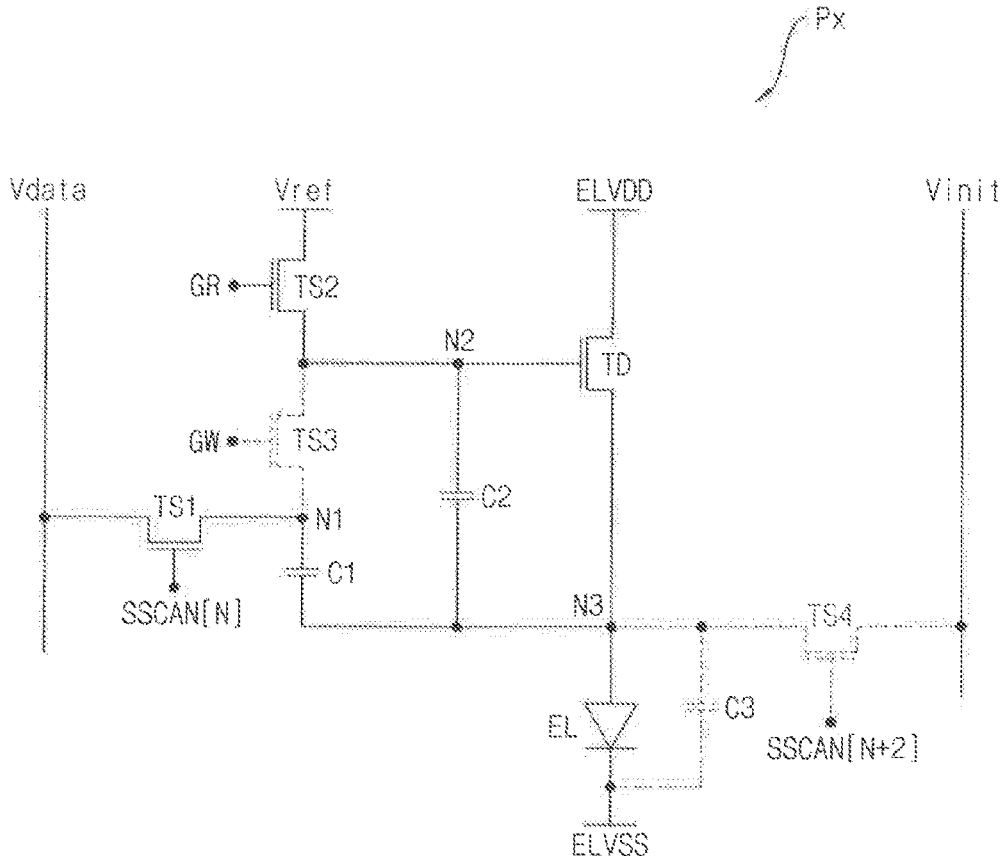

Referring to FIG. 5D, in the data writing period T4, the scan signal SSCAN[N] may be provided to the pixel Px through the Nth scan line and the first control signal GR may be provided to the pixel Px through the first control line. The first switching transistor TS1 may turn on in response to the scan signal SSCAN[N] and couple the data line and the first node N1. Thus, the data voltage Vdata of a current frame provided through the data line may be provided to the first node N1. The data voltage Vdata provided to the first node N1 may be stored in the first capacitor C1. The second switching transistor TS2 may turn on in response to the first control signal GR and couple the reference voltage providing line and the second node N2. Thus, the reference voltage Vref may be provided to the second node N2. The difference between the reference voltage Vref and the threshold voltage may be stored in the second capacitor C2.

Figure 5E:
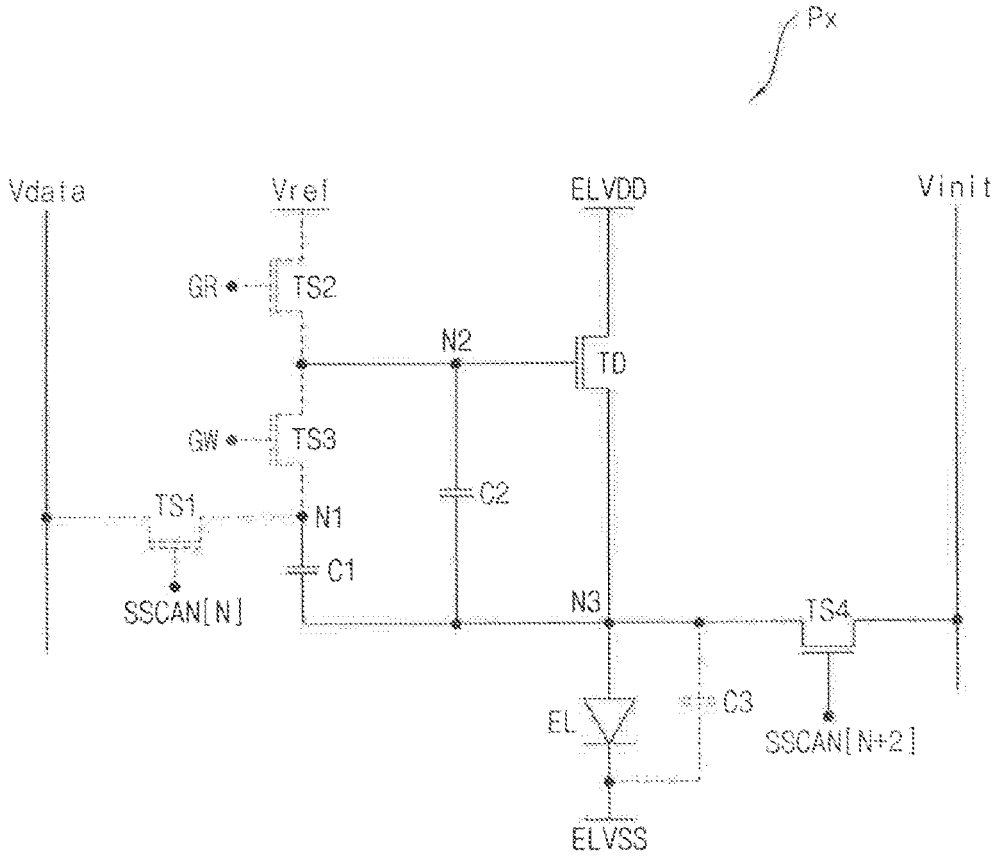

Referring to FIG. 5E, in the second initialization period T5, the scan signal SSCAN[N+2] may be provided to the pixel Px through the (N+2)th scan line and the initialization voltage Vinit may be provided to the pixel Px through the initialization line. The fourth switching transistor TS4 may turn on in response to the scan signal SSCAN[N+2] provided through the (N+2)th scan line and couple the initialization line and the third node N3. Thus, the initialization voltage Vinit may be provided to the third node N3 and the anode electrode of the organic light emitting diode EL may be initialized to the initialization voltage Vinit.

Figure 5F:
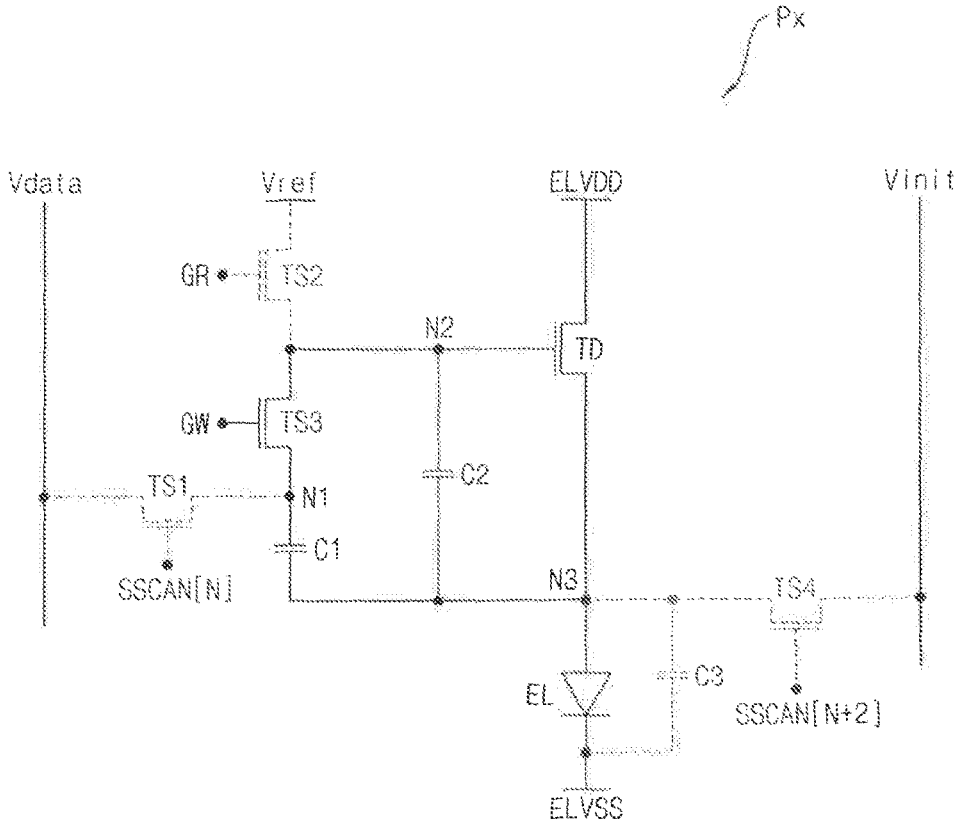

Referring to FIG. 5F, in the emission period T6, the second control signal GW may be provided to the pixel Px through the second control line. The third switching transistor TS3 may turn on in response to the second control signal GW provided through the second control line and couple the second node N2 and the third node N3. The driving transistor TD may turn on in response to the voltage provided to the second node N2 and may generate the driving current. Here, the threshold voltage of the driving transistor TD may be offset by the voltage stored in the second capacitor C2. In other words, the driving transistor TD may generate the driving current based on Equation 1 below, $$Ioled=k(Vdata-Vref)^2 \quad \text{EQUATION 1}$$

where Ioled is the driving current, k is a proportion coefficient, Vdata is the data voltage of the current frame, and Vref is the reference voltage. The proportion coefficient k may be determined by the structure and physical properties of the driving transistor TD.

As described above, the emission waiting times of the pixels may be substantially the same because the pixel Px of the organic light emitting display device includes the second initialization period T5 after the data writing period T4. Thus, the luminance uniformity defect that occurs due to the difference in emission waiting times of the pixels may be minimized. Further, the pixel Px of the organic light emitting display device may compensate the threshold voltage of the driving transistor TD and the driving current may uniformly flow through the organic light emitting diode EL. Thus, the luminance uniformity defect that occurs due to the difference in threshold voltages of the pixels may be minimized. If the pixel includes transistors coupled to a source electrode or a drain electrode of the driving transistor (e.g., an emission control transistor), a voltage higher than the high-power voltage ELVDD may need to be provided to the pixel through the high-power voltage line in consideration of a voltage drop. However, the pixel Px of the organic light emitting display device 100 does not include transistors coupled to a source electrode or a drain electrode of the driving transistor TD. Thus, power consumption of the organic light emitting display device 100 may be reduced.

Figure 6:
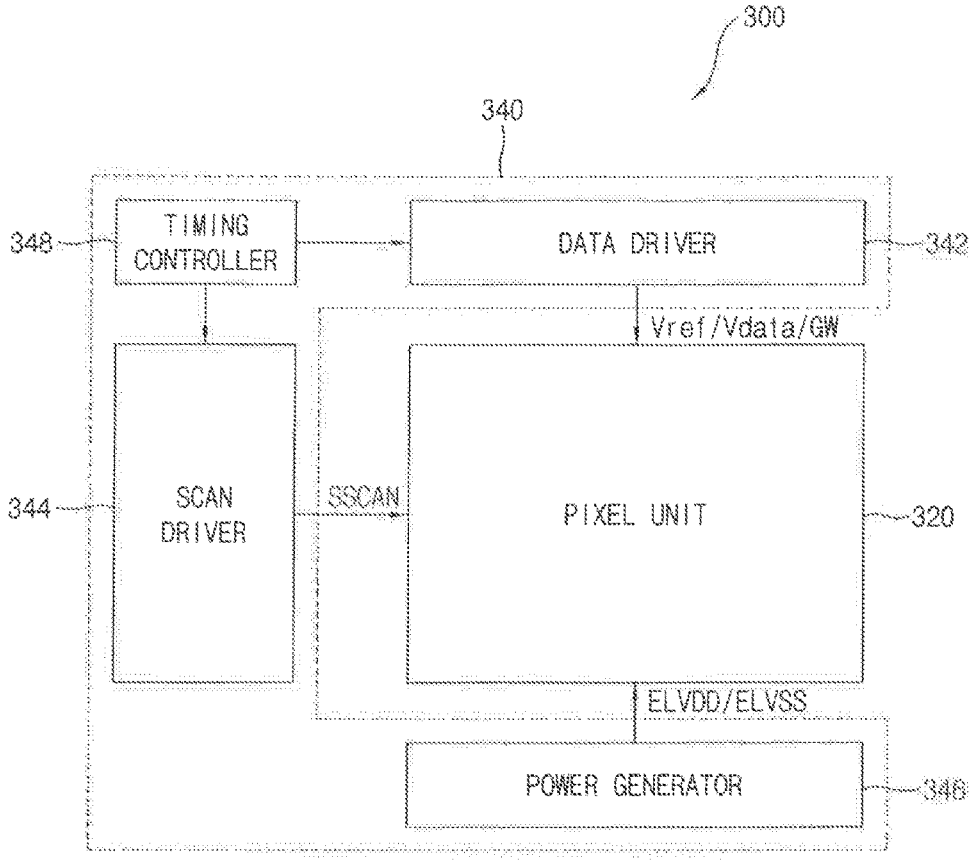
FIG. 6 is a block diagram illustrating an organic light emitting display device according to an exemplary embodiment of the inventive concept.
Figure 7:
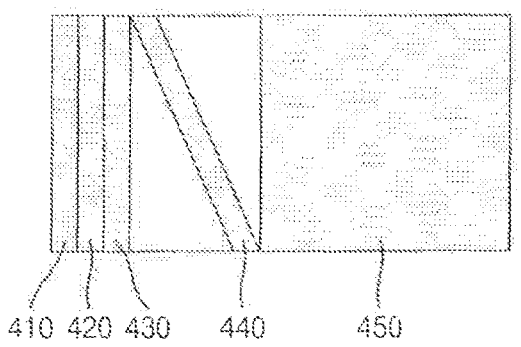
FIG. 7 is a diagram to illustrate a driving method of the organic light emitting display device of FIG. 6 according to an exemplary embodiment of the inventive concept.

FIG. 6 is a block diagram illustrating an organic light emitting display device and FIG. 7 is a diagram to illustrate a driving method of the organic light emitting display device of FIG. 6, according to an exemplary embodiment of the inventive concept.

Referring to FIG. 6, an organic light emitting display device 300 may include a pixel unit 320 and a driving unit 340.

The pixel unit 320 may be coupled to a data driver 342 of the driving unit 340 through a plurality of data lines. The pixel unit 320 may be coupled to a scan driver 344 of the driving unit 340 through a plurality of scan lines. The pixel unit 320 may be coupled to a power voltage generator 346 of the driving unit 340 through power voltage lines. The pixel unit 320 may include at least one pixel formed in intersection regions of the plurality of data lines and the plurality of scan lines. Each of the pixels may be operated in response to signals provided from the driving unit 340. Hereinafter, the at least one pixel will be described in detail with reference to FIG. 8.

The driving unit 340 may drive the pixel unit 320. The driving unit 340 may include the data driver 342, the scan driver 344, a timing controller 348, and the power voltage generator 346. The data driver 342 may convert an input data into the data voltage Vdata corresponding to the input data, may provide the data voltage Vdata or the reference voltage Vref through the data line, and may provide the control signal GW through the control line. The scan driver 344 may provide the scan signal SSCAN to the pixel unit 320 through the plurality of scan lines. The power voltage generator 346 may provide the high-power voltage ELVDD to the pixel unit 320 through high-power voltage lines and the low-power voltage ELVSS to the pixel unit 320 through low-power voltage lines. The timing controller 348 may control an operation of the organic light emitting display device 300. For example, the timing controller 348 may control the operation of the organic light emitting display device 300 by providing timing control signals to the data driver 342 and the scan driver 344. According to exemplary embodiments of the inventive concept, the data driver 142, the scan driver 144, and the timing controller 148 may be implemented as an integrated circuit (IC). Alternatively, the data driver 142, the scan driver 144, and the timing controller 148 may be implemented as two or more integrated circuits (IC).

Referring to FIG. 7, the driving unit 340 may receive the input data for the pixel and divide one frame into a non-emission period 410, an initialization period 420, a threshold voltage compensation period 430, a data writing period 440, and an emission period 450.

in the non-emission period 410, the data driver 342 of the driving unit 340 may provide the control signal GW to the pixel unit 320 through the control line and provide the high-power voltage ELVDD having a first power voltage level (e.g., 0V) through the high-power voltage line. Here, the pixels in the pixel unit 320 do not emit light in response to the signals provided from the driving unit 340. In the initialization period 420, the data driver 342 of the driving unit 340 may provide the reference voltage Vref and the control signal GW to the pixel unit 320. The scan driver 344 of the driving unit 340 may provide the scan signal SSCAN through the scan line. Further, the power voltage generator 346 of the driving unit 340 may provide the high-power voltage ELVDD having the first power voltage level (e.g., 0V) through the high-power voltage line. Here, the anode electrode of the organic light emitting diode may be initialized in response to the signals provided from the driving unit 340. In the threshold voltage compensation period 430, the data driver 342 may provide the reference voltage Vref and the control signal GW to the pixel unit 320. The scan driver 344 of the driving unit 340 may provide the scan signal SSCAN through the scan line. Further, the power voltage generator 346 of the driving unit 340 may provide the high-power voltage ELVDD having a second power voltage level (e.g., 13V) through the high-power voltage line. Here, the threshold voltage of the driving transistor in the pixel may be stored in response to the signals provided from the driving unit 340.

In the data writing period 440, the scan driver 344 of the driving unit 340 may provide the scan signal SSCAN to the pixel unit 320 through the scan line and the data driver 342 of the driving unit 340 may provide the data voltage Vdata, corresponding to the input data, to the pixel unit 320 through the data line. Further, the power voltage generator 346 of the driving unit 340 may provide the high-power voltage ELVDD having the second power voltage level (e.g., 13V) through the high-power voltage line. Here, the data voltage Vdata may be stored in the capacitor in the pixel in response to the signals provided from the driving unit 340. In the emission period 450, the data driver 342 of the driving unit 340 may provide the control signal GW to the pixel unit 320 through the control line and the power voltage generator 346 of the driving unit 340 may provide the high-power voltage ELVDD having the second power voltage level (e.g., 13V) through the high-power voltage line. Here, all pixels of the pixel unit 320 may simultaneously emit light in response to the data voltage Vdata stored during the data writing period 440.

As described above, the organic light emitting display device 300, according to exemplary embodiments of the inventive concept, may divide one frame into the non-emission period 410, the initialization period 420, the threshold voltage compensation period 430, the data writing period 440, and the emission period 450. Here, the pixel, driven using a simultaneous emission driving technique, may be simplified by providing the high-power voltage ELVDD that has the first power voltage level (e.g., 0V) in the non-emission period 410 and the initialization period 420 and has the second voltage level (e.g., 13V) in the threshold voltage compensation period 430, the data writing period 440, and the emission period 450. Further, because the organic light emitting display device includes the threshold voltage compensation period 430, the threshold voltage of the driving transistor may be compensated and the uniform driving current may flow through the organic light emitting diode regardless of the threshold voltage of the driving transistor. Thus, the luminance uniformity defect that occurs due to the difference in threshold voltages of the pixels may be minimized. If the pixel includes transistors coupled to a source electrode or a drain electrode of the driving transistor (e.g., an emission control transistor), a voltage higher than the high-power voltage ELVDD may need to be provided to the pixels through the high-power voltage line in consideration of a voltage drop. However, the pixel of the organic light emitting display device 300 does not include transistors coupled to a source electrode or a drain electrode of the driving transistor. Thus, power consumption of the organic light emitting display device 300 may be reduced.

Figure 8:
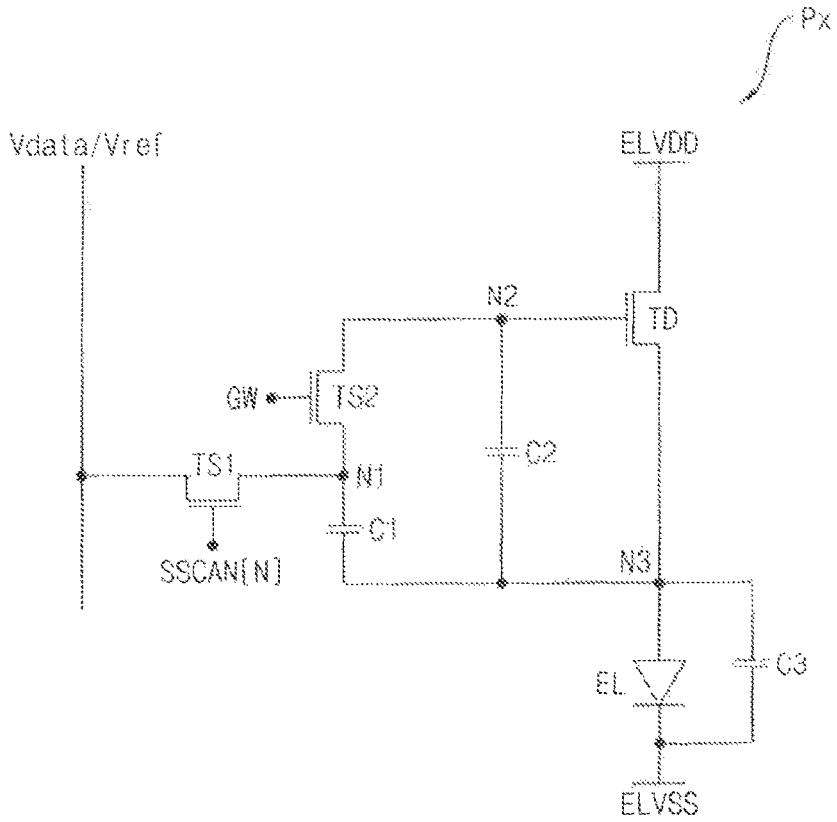
FIG. 8 is a circuit diagram illustrating a pixel included in the organic light emitting display device of FIG. 6 according to an exemplary embodiment of the inventive concept.

FIG. 8 is a circuit diagram illustrating a pixel included in the organic light emitting display device of FIG. 6 according t o an exemplary embodiment of the inventive concept.

Referring to FIG. 8, the pixel Px may include the first switching transistor TS1, the second switching transistor TS2, the first capacitor C1, the second capacitor C2, the organic light emitting display diode EL, the third capacitor C3, and the driving transistor TD.

The gate electrode of the first switching transistor TS1 may be coupled to the Nth scan line. The first switching transistor TS1 may turn on in response to the scan signal SSCAN[N] provided through the Nth scan line. The first switching transistor TS1 may be coupled between the data line and the first node N1. The gate electrode of the second switching transistor TS2 may be coupled to a control line. The second switching transistor TS2 may turn on in response to the control signal GW provided through the control line. The second switching transistor TS2 may be coupled between the first node N1 and the second node N2. The first capacitor C1 may be coupled between the first node and the third node N3. The first capacitor C1 may store the data voltage Vdata provided through the first switching transistor TS1. The second capacitor C2 may be coupled between the second node N2 and the third node N3. The second capacitor C2 may store the threshold voltage of the driving transistor TD.

The organic light emitting diode EL may have an anode electrode coupled to the third node N3 and a cathode electrode coupled to the low-power voltage line. The organic light emitting diode EL may emit light based on the driving current provided from the driving transistor TD. The third capacitor C3 may be coupled between the third node N3 and the cathode electrode of the organic light emitting diode EL. The gate electrode of the driving transistor TD may be coupled to the second node N2. The first electrode of the driving transistor TD may be coupled to the high-power voltage line. The second electrode of the driving transistor TD may be coupled to the third node N3. The driving transistor TD may control the driving current flowing through the organic light emitting diode EL.

Although transistors of the pixel Px of the organic light emitting display device, which includes the first switching transistor TS1, the second switching transistor TS2, and the driving transistor TD, may be implemented as n-channel metal oxide semiconductor (NMOS) transistors, as described with reference to FIG. 8, the pixel Px of the organic light emitting display device is not limited thereto. For example, transistors of the pixel Px may be implemented as p-channel metal oxide semiconductor (PMOS) transistors.

Figure 9:
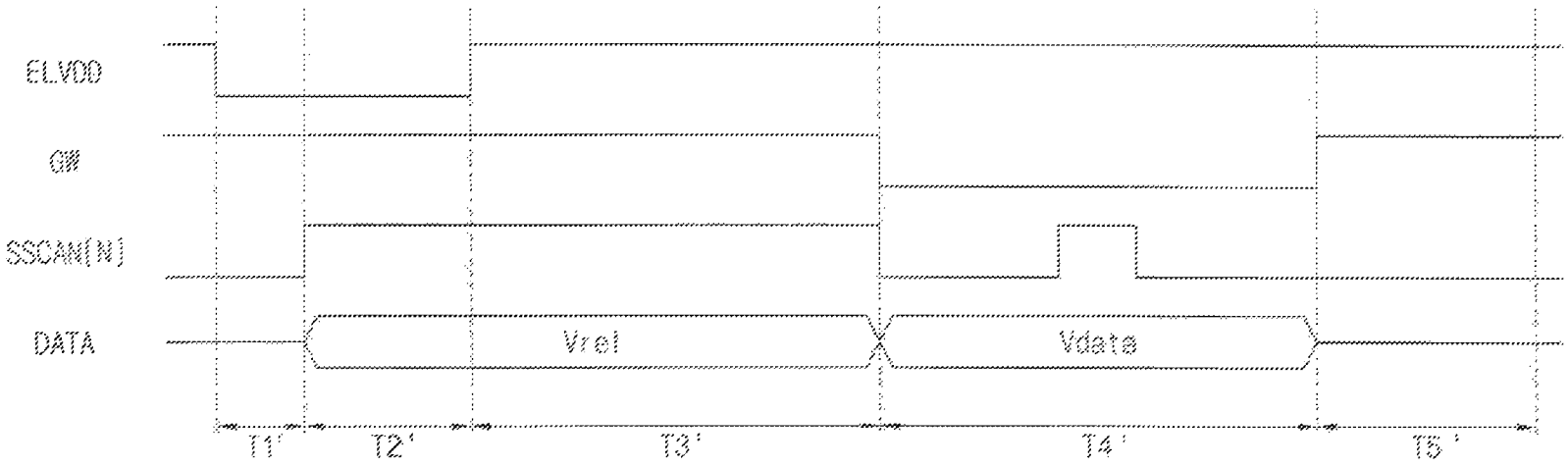
FIG. 9 is a timing diagram to illustrate an operation of the pixel of FIG. 8 according to an exemplary embodiment of the inventive concept.

FIG. 9 is a timing diagram to illustrate an operation of the pixel of FIG. 8 and FIGS. 10A through 10E are circuit diagrams to illustrate an operation of the pixel of FIG. 8, according to an exemplary embodiment of the inventive concept.

Referring to FIG. 9, the driving unit 340 may receive input data for the pixel Px and may divide one frame into a non-emission period T1', an initialization period T2', a threshold voltage compensation period T3', a data writing period T4', and an emission period T5'.

Figure 10A:
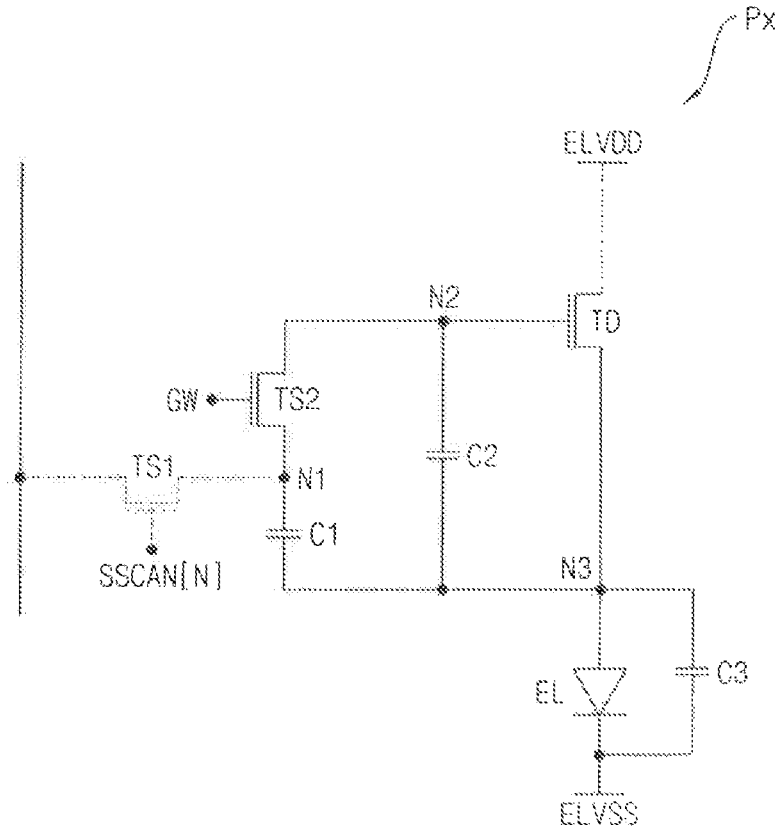
FIGS. 10A through 10E are circuit diagrams to illustrate an operation of the pixel of FIG. 8 according to an exemplary embodiment of the inventive concept.

Referring to FIG. 10A, in the non-emission period T1', the control signal GW may be provided to the pixel Px through the control line. The high-power voltage ELVDD having the first power voltage level (e.g., 0V) may be provided to the pixel Px through the high power voltage line. The second switching transistor TS2 may turn on in response to the control signal GW and couple the first node N1 and the second node N2. The driving transistor TD may turn off in response to the high-power voltage ELVDD having the first power voltage level (e.g., 0V). Thus, the organic light emitting diode EL does not emit light.

Figure 10B:
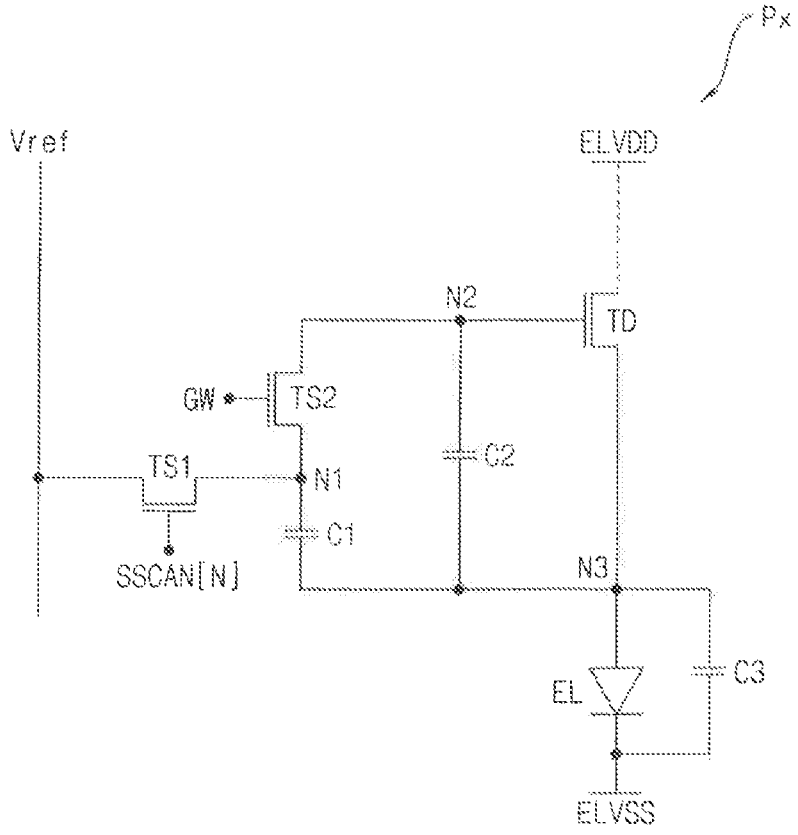

Referring to FIG. 10B, in the initialization period T2', the control signal GW may be provided to the pixel Px through the control line, the scan signal SSCAN[N] may be provided to the pixel Px through the scan line, and the reference voltage Vref may be provided to the pixel Px through the data line. Further, the high-power voltage ELVDD having the first power voltage level (e.g., 0V) may be provided to the pixel Px through the high power voltage line. The first switching transistor TS1 may turn on in response to the scan signal SSCAN[N] and couples the data line and the first node N1. The reference voltage Vref, provided through the data line, may be provided to the first node N1. Thus, the anode electrode of the organic light emitting diode EL may be initialized.

Figure 10C:
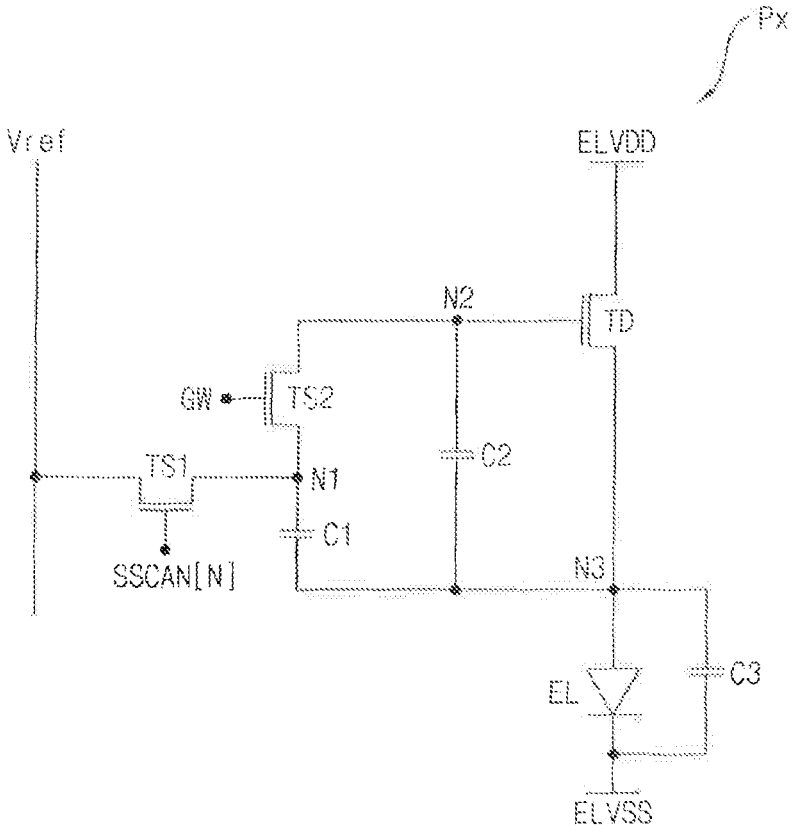

Referring to FIG. 10C, in the threshold voltage compensation period T3', the control signal GW may be provided to the pixel Px through the control line, the scan signal SSCAN [N] may be provided to the pixel Px through the scan line, and the reference voltage Vref may be provided to the pixel Px through the data line. Further, the high-power voltage ELVDD having the second power voltage level (e.g., 13V) may be provided to the pixel Px through the high power voltage line. The first switching transistor TS1 may turn on in response to the scan signal SSCAN[N] and couple the data line and the first node N1. The second switching transistor TS2 may turn on in response to the control signal GW and couple the first node N1 and the second node N2. Thus, the reference voltage Vref may be provided to the second node N2. Here, the driving transistor TD may turn on. Accordingly, the difference between the reference voltage Vref and the threshold voltage of the driving transistor TD may be stored in the second capacitor C2.

Figure 10D:
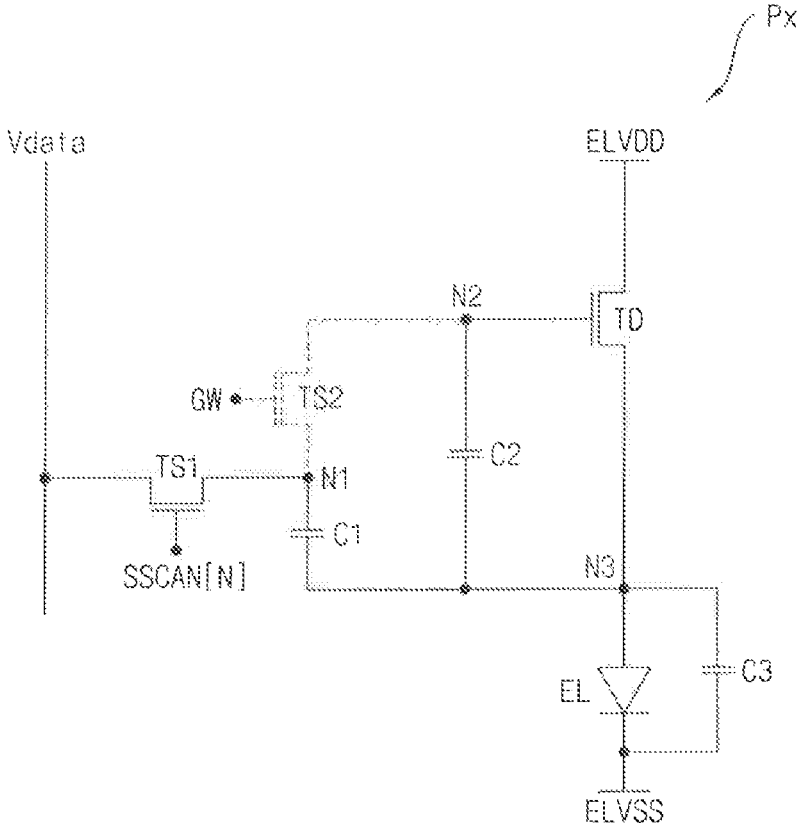
Figure 10E:
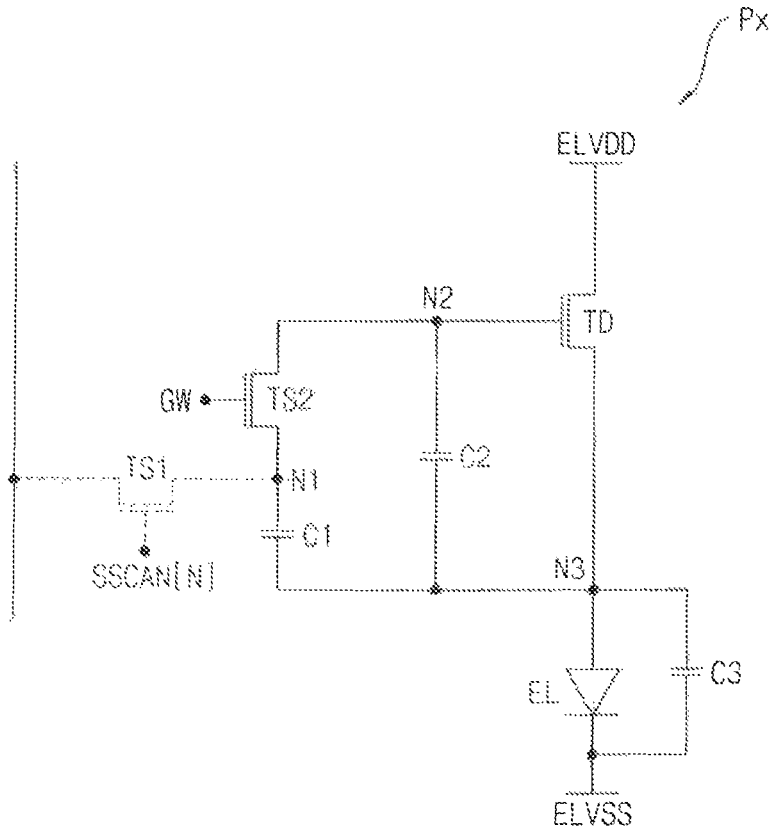

Referring to FIG. 10D, in the data writing period T4', the scan signal SSCAN[N] may be provided to the pixel Px through the scan line and the data voltage Vdata may be provided to the pixel Px through the data line. Further, the high-power voltage ELVDD having the second power voltage level (e.g., 13V) may be provided to the pixel Px through the high power voltage line. The first switching transistor TS1 may turn on in response to the scan signal SSCAN[N] and couple the data line and the first node N1. Thus, the data voltage Vdata provided from the data line may be provided to the first node N1. The data voltage Vdata, provided to the first node N1, may be stored in the first capacitor C1.

Referring to 10E, in the emission period T5', the control signal GW may be provided to the pixel Px through the control line. The high-power voltage ELVDD having the second power voltage level (e.g., 13V) may be provided to the pixel Px through the high power voltage line. The second switching transistor TS2 may turn on in response to the control signal GW provided through the control line and couple the first node N1 and the second node N2. The driving transistor TD may turn on in response to a voltage provided to the second node N2 and generate the driving current flowing through the organic light emitting diode EL. Here, the threshold voltage of the driving transistor TD may be offset by the data voltage Vdata stored in the second capacitor C2. In other words, the driving transistor TD may generate the driving current based on Equation 1.

As described above, the pixel Px, driven using the simultaneous emission driving technique, may be simplified by providing the high-power voltage ELVDD having the first power voltage level (e.g., 0V) in the non-emission period T1' and the initialization period T2' and the second power voltage level (e.g., 13V) in the threshold voltage compensation period T3', the data writing period T4', and the emission period T5'. Further, because the organic light emitting display device 300 includes the threshold voltage compensation period T3', the threshold voltage of the driving transistor TD may be compensated and the uniform driving current may flow through the organic light emitting diode EL regardless of the threshold voltage of the driving transistor. Thus, the luminance uniformity defect that occurs due to the difference in threshold voltages of the pixels may be minimized. If the pixel includes transistors coupled to a source electrode or a drain electrode of the driving transistor (e.g., an emission control transistor), a voltage higher than the high-power voltage ELVDD may need to be provided to the pixels through the high-power voltage line in consideration of a voltage drop. However, the pixel Px of the organic light emitting display device 300 does not include transistors coupled to a source electrode or a drain electrode of the driving transistor TD. Thus, power consumption of the organic light emitting display device 300 may be reduced.

The present inventive concept may be applied to a transparent display device or an electronic device having the transparent display device. For example, the present inventive concept may be applied to a computer monitor, a laptop, a digital camera, a cellular phone, a smart phone, a smart pad, a television, a personal digital assistant (PDA), a portable multimedia player (PMP), an MP3 player, a navigation system, a game console, a video phone, etc.

According to an exemplary embodiment of the inventive concept, as described above, the emission waiting times of the pixels of the organic light emitting display device may be substantially the same because the pixels of the organic light emitting display device include the initialization period after the data writing period. Thus, the luminance uniformity defect that occurs due to difference in emission waiting times of the pixels may be minimized.

Further, the pixel of the organic light emitting display device may compensate the threshold voltage of the driving transistor and the driving current may uniformly flow through the organic light emitting diode. Thus, the luminance uniformity defect that occurs due to the difference in threshold voltages of the pixels may be minimized.

Additionally, the pixel of the organic light emitting display device does not include transistors coupled to a source electrode or a drain electrode of the driving transistor. Thus, power consumption of the organic light emitting display device may be reduced.

While the inventive concept has been shown and described with reference to the exemplary embodiments thereof, it will be understood by those of ordinary skill in the art that various changes in form and details may be made thereto without departing from the spirit and scope of the present inventive concept as defined by the following claims.

What is claimed is:

1. An organic light emitting display device comprising:

a pixel unit including at least one pixel; and a driving unit configured to drive the pixel unit, wherein the at least one pixel comprises:

a first switching transistor configured to turn on in response to a first scan signal provided through an Nth scan line, wherein the first switching transistor is coupled between a data line and a first node and N is an integer greater than or equal to 1;

a second switching transistor configured to turn on in response to a first control signal, wherein the second switching transistor is coupled between a reference voltage providing line and a second node;

a third switching transistor configured to turn on in response to a second control signal, wherein the third switching transistor is coupled between the first node and the second node;

a fourth switching transistor configured to turn on in response to a second scan signal provided through an (N+2)th scan line, wherein the fourth switching transistor is coupled between an initialization line and a third node;

a first capacitor coupled between the first node and the third node;

a second capacitor coupled between the second node and the third node;

an organic light emitting diode having an anode electrode coupled to the third node and a cathode node coupled to a low-power voltage line;

a third capacitor coupled between the third node and the cathode electrode of the organic light emitting diode; and a driving transistor having a gate electrode coupled to the second node, a first electrode coupled to a high-power voltage line, and a second electrode coupled to the third node, wherein the driving transistor is configured to control a driving current flowing through the organic light emitting diode in response to a voltage of the second node.

2. The organic light emitting display device of claim 1, wherein the driving unit receives an input data for the pixel and divides one frame into a non-emission period, a first initialization period, a threshold voltage compensation period, a data writing period, a second initialization period, and an emission period.

3. The organic light emitting display device of claim 2, wherein the organic light emitting diode does not emit light in the non-emission period.

4. The organic light emitting display device of claim 2, wherein the anode electrode of the organic light emitting diode is initialized to an initialization voltage in the first initialization period.

5. The organic light emitting display device of claim 2, wherein a threshold voltage of the driving transistor is stored in the second capacitor in the threshold voltage compensation period.

6. The organic light emitting display device of claim 2, wherein a data voltage, corresponding to the input data, is provided to the pixel in response to the first scan signal in the data writing period.

7. The organic light emitting display device of claim 2, wherein the anode electrode of the organic light emitting diode is initialized to an initialization voltage in the second initialization period.

8. The organic light emitting display device of claim 2, wherein emission waiting times of the at least one pixel are substantially the same and in the emission period, each of the at least one pixel emits light at substantially the same time.

9. The organic light emitting display device of claim 2, wherein the first switching transistor turns on in response to the first scan signal provided through the Nth scan line in the non-emission period and the data writing period, and provides a data voltage to the first node.

10. The organic light emitting display device of claim 2, wherein the second switching transistor turns on in response to the first control signal in the non-emission period, the threshold voltage compensation period, and the data writing period, and provides a reference voltage to the second node.

11. The organic light emitting display device of claim 2, the third switching transistor turns on in response to the second control signal in the threshold voltage compensation period and the emission period, and couples the second node and the third node.

12. The organic light emitting device of claim 2, wherein the fourth switching transistor turns on in response to the second scan signal provided through the (N+2)th scan line in the first initialization period and the second initialization period, and provides an initialization voltage to the third node.

13. An organic light emitting display device comprising:

a pixel unit including at least one pixel; and a driving unit configured to drive the pixel unit, wherein the at least one pixel comprises:

a first switching transistor configured to turn on in response to a scan signal provided through a scan line, wherein the first switching transistor is coupled between a data line and a first node;

a second switching transistor configured to turn on in response to a control signal, wherein the second switching transistor is coupled between the first node and a second node;

a first capacitor coupled between the first node and a third node;

a second capacitor coupled between the second node and the third node;

an organic light emitting diode having an anode electrode coupled to the third node and a cathode electrode coupled to a low-power voltage line;

a third capacitor coupled between the third node and the cathode electrode of the organic light emitting diode; and a driving transistor having a gate electrode coupled to the second node, a first electrode coupled to a high-power voltage line, and a second electrode coupled to the third node, wherein the driving transistor is configured to control a driving current flowing through the organic light emitting diode in response to a voltage of the second node.

14. The organic light emitting display device of claim 13, wherein the driving unit receives an input data for the pixel and divides one frame into a non-emission period, an initialization period, a threshold voltage compensation period, a data writing period, and an emission period.

15. The organic light emitting display device of claim 14, wherein the organic light emitting diode does not emit in the non-emission period.

16. The organic light emitting display device of claim 14, wherein the anode electrode of the organic light emitting diode is initialized to an initialization voltage in the initialization period.

17. The organic light emitting display device of claim 14, wherein a difference between a threshold voltage of the driving transistor and a reference voltage is stored in the second capacitor in threshold voltage compensation period.

18. The organic light emitting display device of claim 14, wherein a data voltage, corresponding to the input data, is provided to the pixel in response to the scan signal in the data writing period.

19. The organic light emitting display device of claim 14, wherein emission waiting times of the at least one pixel are substantially the same and in the emission period, each of the at least one pixel emits light at substantially the same time.

20. The organic light emitting display device of claim 14, wherein the driving unit provides a high-power voltage having a first voltage level in the non-emission period and the initialization period and a second voltage level in the data writing period and the emission period.

21. An organic light emitting display device comprising:

a pixel unit comprising at least one pixel;

a data driver configured to provide a data voltage to the pixel unit;

a scan driver configured to provide a first and second scan signal to the pixel unit;

a power voltage generator configured to provide a reference voltage, an initialization voltage, a high-power voltage, and a low-power voltage to the pixel unit; and a timing controller configured to provide timing control signals to the data driver and the scan driver, wherein the at least one pixel comprises:

a first switching transistor with a gate electrode coupled to a first scan line providing the first scan signal, a first electrode coupled to a data line providing the data voltage, and a second electrode coupled to a first node;

a second switching transistor with a gate electrode coupled to a first control line providing a first control signal, a first electrode coupled to a reference voltage providing line providing the reference voltage, and a second electrode coupled to a second node;

a third switching transistor with a gate electrode coupled to a second control line providing a second control signal, a first electrode coupled to the first node, and a second electrode coupled to the second node;

a fourth switching transistor with a gate electrode coupled to a second scan line providing the second scan signal, a first electrode coupled to an initialization line providing the initialization voltage, and a second electrode coupled to a third node;

a driving transistor with a gate electrode coupled to the second node, a first electrode coupled to a high-power voltage line providing the high-power voltage, and a second electrode coupled to the third node; and an organic light emitting diode with an anode electrode coupled to the third node and a cathode electrode coupled to a low-power voltage line providing the low-power voltage.

* * * * *